US008695228B2

(12) United States Patent
Lee et al.

(10) Patent No.: US 8,695,228 B2
(45) Date of Patent: Apr. 15, 2014

(54) COMPOSITE WASHING SYSTEM

(75) Inventors: Deug Hee Lee, Gimhae-si (KR); Hung Myong Cho, Gyeongsangnam-do (KR); Byung Hwan Ahn, Gimhae-si (KR); Soung Bong Choi, Changwon-si (KR); Young Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1081 days.

(21) Appl. No.: 11/289,652

(22) Filed: Nov. 30, 2005

(65) Prior Publication Data

US 2006/0137206 A1 Jun. 29, 2006

(30) Foreign Application Priority Data

Nov. 30, 2004 (KR) ..... 10-2004-0099134

(51) Int. Cl.
*F26B 19/00* (2006.01)

(52) U.S. Cl.
USPC ..... 34/86; 34/595; 34/610

(58) Field of Classification Search
USPC ..... 34/86, 595, 601, 606, 602, 610; 68/19
See application file for complete search history.

(56) References Cited

U.S. PATENT DOCUMENTS 571,555 A * 11/1896 Coffield ..... 184/6.5
1,877,283 A * 9/1932 Diskin ..... 223/86
1,930,360 A * 10/1933 Julien ..... 68/157
2,118,786 A * 5/1938 Chestnutt ..... 34/106
2,310,680 A * 2/1943 Dinley ..... 34/74
2,361,297 A * 10/1944 Kutsche ..... 34/79
2,424,737 A * 7/1947 Broglie ..... 34/82
2,498,172 A * 2/1950 Mintner et al. ..... 432/107
2,503,330 A * 4/1950 Geldhof ..... 432/117
2,533,888 A * 12/1950 Kahn ..... 68/12.09
2,539,407 A * 1/1951 Dinley ..... 34/74
2,553,581 A * 5/1951 Hatfield ..... 68/12.14
2,617,203 A * 11/1952 Murray ..... 34/82
2,635,354 A * 4/1953 Geldhof et al. ..... 34/131
2,680,917 A * 6/1954 Finley ..... 34/596

(Continued)

FOREIGN PATENT DOCUMENTS

DE 3204718 9/1982
DE 3417481 A1 * 11/1985 ..... H02H 7/18

(Continued)

*Primary Examiner* — Steve M Gravini
(74) *Attorney, Agent, or Firm* — McKenna Long & Aldridge LLP

(57) ABSTRACT

A composite washing system is disclosed which is capable of continuously circulating laundry-drying air through dryers while obtaining a more efficient drying effect, so that the composite washing system has a suitable built-in structure having minimal influence on the indoor environment. The composite washing system includes a drum dryer which dries laundry to be dried, and includes a drying drum adapted to receive the laundry, a hot air supply path adapted to guide a flow of hot air, a hot air supplier arranged in the hot air supply path to generate the hot air, and an air condenser adapted to condense the hot air, a cabinet dryer which is coupled to one side of the drum dryer, and is defined with a laundry receiving compartment, the cabinet dryer including a hot air inlet duct adapted to receive the hot air flowing through the hot air supply path, and a hot air supplying device which is arranged in the cabinet dryer to receive the hot air from the hot air inlet duct and to supply the received hot air to an inside of the laundry.

18 Claims, 5 Drawing Sheets

(56) References Cited

U.S. PATENT DOCUMENTS 2,681,754 A * 6/1954 Lefton et al. 223/86
2,741,408 A * 4/1956 Brokenshire 223/88
2,799,948 A * 7/1957 Morrison 34/90
2,802,283 A * 8/1957 Strike 34/87
2,813,414 A * 11/1957 Johnston 68/20
2,817,157 A * 12/1957 McCormick 34/82
2,827,783 A * 3/1958 Handley 68/12.15
2,834,121 A * 5/1958 Geldhof 34/75
2,843,943 A * 7/1958 Geldhof et al. 34/75
2,853,798 A * 9/1958 Morrison 34/75
2,864,175 A * 12/1958 Stone 34/75
2,864,250 A * 12/1958 Nichols 68/19.1
2,866,273 A * 12/1958 Geldhof 34/75
2,873,537 A * 2/1959 Gray, Jr. et al. 34/75
2,873,539 A * 2/1959 Morey 34/597
2,892,335 A * 6/1959 Gray, Jr. 68/16
2,931,687 A * 4/1960 Mitter 312/323
2,959,044 A * 11/1960 Stone 68/12.15
2,985,966 A * 5/1961 Martin 34/75
2,991,990 A * 7/1961 Mitter 432/107
2,996,809 A * 8/1961 Shapter 34/75
3,029,525 A * 4/1962 Pinder 34/75
3,040,440 A * 6/1962 Mellinger et al. 34/75
3,050,867 A * 8/1962 Friedman 34/86
3,050,974 A * 8/1962 Smith 68/20
3,066,423 A * 12/1962 Solem 34/86
3,067,986 A * 12/1962 Grantham 366/140
3,091,955 A * 6/1963 Taylor et al. 68/19.2
3,098,726 A * 7/1963 Stone 34/596
3,155,462 A * 11/1964 Erickson et al. 34/82
3,173,767 A * 3/1965 Perloff 34/82
3,197,886 A * 8/1965 Brame et al. 34/90
3,231,909 A * 2/1966 Candor 8/159
3,242,589 A * 3/1966 Jacobs 34/595
3,417,481 A * 12/1968 Rumsey, Jr. 34/72
3,592,585 A * 7/1971 Candor 8/151
3,643,349 A * 2/1972 Zenz 34/595
3,670,425 A * 6/1972 Benjamin et al. 34/542
3,673,701 A * 7/1972 Albertson 34/90
3,721,015 A * 3/1973 Sisler et al. 34/601
3,739,487 A * 6/1973 Clark 34/77
3,748,746 A * 7/1973 Robandt 34/82
3,805,404 A * 4/1974 Gould 34/75
3,815,258 A * 6/1974 Beard, Jr. 34/602
3,816,070 A * 6/1974 Candor et al. 8/158
3,826,607 A * 7/1974 Kuhn 432/105
3,854,219 A * 12/1974 Staats 34/265
3,866,333 A * 2/1975 Sarukahanian et al. 34/75
3,866,336 A * 2/1975 Bereza 34/201
3,889,392 A * 6/1975 Davis et al. 34/82
3,921,308 A * 11/1975 Freze 34/395
3,974,573 A * 8/1976 Daily et al. 34/551
4,006,535 A * 2/1977 Nelson 34/572
4,007,546 A * 2/1977 Sauer 34/602
4,069,596 A * 1/1978 Sisler 34/242
4,086,709 A * 5/1978 Jackson 34/90
4,103,433 A * 8/1978 Taylor 34/86
4,123,851 A * 11/1978 Itoh et al. 34/549
4,180,919 A * 1/1980 Baltes 34/449
4,189,341 A * 2/1980 McPherson et al. 216/55
4,204,339 A * 5/1980 Muller 34/75
4,279,082 A * 7/1981 Commander 34/82
4,338,731 A * 7/1982 Shames et al. 34/82
4,412,636 A * 11/1983 Greene 224/313
4,516,335 A * 5/1985 Aoki et al. 34/608
4,540,092 A * 9/1985 DeSantis 211/4
4,586,269 A * 5/1986 St. Louis 34/601
4,603,489 A * 8/1986 Goldberg 34/77
4,615,125 A * 10/1986 Wyborn 34/92
4,669,199 A * 6/1987 Clawson et al. 34/82
4,677,760 A * 7/1987 St. Louis 34/90
4,682,424 A * 7/1987 Irving 34/621
4,700,495 A * 10/1987 Drews et al. 34/603
4,703,565 A * 11/1987 Kantor 34/261
4,753,018 A * 6/1988 Golichowski 34/603
4,754,556 A * 7/1988 Carr 34/601
4,788,775 A * 12/1988 Ahmed 34/552
4,811,495 A * 3/1989 Huang et al. 34/131
4,819,341 A * 4/1989 Gayso 34/86
4,891,892 A * 1/1990 Narang 34/86
4,908,959 A * 3/1990 Kretchman et al. 34/609
4,981,221 A * 1/1991 Davis 211/37
5,042,170 A * 8/1991 Hauch et al. 34/82
5,042,171 A * 8/1991 Obata et al. 34/604
5,042,172 A * 8/1991 Foco et al. 34/235
5,067,253 A * 11/1991 Hauch et al. 34/82
5,103,985 A * 4/1992 Davis 211/37
5,107,606 A * 4/1992 Tsubaki et al. 34/596
5,127,169 A * 7/1992 Ellingson 34/601
5,136,792 A * 8/1992 Janecke 34/78
5,207,764 A * 5/1993 Akabane et al. 68/20
5,212,969 A * 5/1993 Tsubaki et al. 68/19.2
5,253,433 A * 10/1993 Frey 34/603
5,279,047 A * 1/1994 Janecke 34/78
5,317,816 A * 6/1994 Kadakia 34/603
5,421,103 A * 6/1995 Wunderlich 34/599
5,463,821 A * 11/1995 Gauer 34/261
5,524,358 A * 6/1996 Matz 34/275
5,546,678 A * 8/1996 Dhaemers 34/275
5,555,640 A * 9/1996 Ou 34/202
5,555,647 A * 9/1996 Torborg et al. 34/601
5,661,914 A * 9/1997 Millet 34/601
5,701,684 A * 12/1997 Johnson 34/595
5,709,040 A * 1/1998 Horwitz 34/565
5,715,555 A 2/1998 Reber et al.
5,755,040 A * 5/1998 Ou 34/202
5,870,836 A * 2/1999 Grimes 34/202
6,067,723 A * 5/2000 Lafrenz 34/61
6,098,312 A * 8/2000 Tuggle 34/607
6,155,415 A * 12/2000 Runyan 206/279
6,385,862 B1 * 5/2002 Vande Haar 34/441
6,425,192 B2 * 7/2002 Arrieta et al. 34/486
6,463,940 B1 * 10/2002 Thomas et al. 134/56 R
6,637,630 B1 * 10/2003 Rivenburgh 223/85
6,665,953 B2 * 12/2003 Woo et al. 34/527
6,678,969 B1 * 1/2004 Hong 34/595
6,698,107 B2 * 3/2004 Song et al. 34/595
6,745,496 B2 * 6/2004 Cassella 34/621
6,796,055 B2 * 9/2004 Baltes 34/449
6,807,751 B2 * 10/2004 Han et al. 34/601
6,829,845 B2 * 12/2004 Han et al. 34/603
6,832,441 B2 * 12/2004 Jeong et al. 34/318
6,868,621 B1 * 3/2005 Grimm et al. 34/92
6,904,703 B2 * 6/2005 Naganawa et al. 34/596
6,922,913 B2 * 8/2005 Hood et al. 34/595
6,928,752 B2 * 8/2005 Johnson et al. 34/595
6,954,995 B2 * 10/2005 Kitamura et al. 34/597
6,968,632 B2 * 11/2005 Guinibert et al. 34/602
7,020,985 B2 * 4/2006 Casey et al. 34/595
7,024,801 B2 * 4/2006 Hwang 34/603
7,032,326 B2 * 4/2006 Hong 34/602
7,043,855 B2 * 5/2006 Heilman et al. 34/389
7,065,905 B2 * 6/2006 Guinibert et al. 34/603
7,069,669 B2 * 7/2006 Park et al. 34/603
7,093,377 B2 * 8/2006 Doh et al. 34/596
7,117,613 B2 * 10/2006 Guinibert et al. 34/534
7,137,211 B2 * 11/2006 Johnson et al. 34/381
7,140,121 B2 * 11/2006 Casella et al. 34/201
7,146,749 B2 * 12/2006 Barron et al. 34/596
7,191,546 B2 * 3/2007 Maruca 34/201
7,204,039 B2 * 4/2007 Cho et al. 34/596
7,225,562 B2 * 6/2007 Guinibert et al. 34/601
7,228,647 B2 * 6/2007 Hong 34/596
7,249,699 B2 * 7/2007 Hill et al. 223/94
7,257,905 B2 * 8/2007 Guinibert et al. 34/82
7,320,184 B2 * 1/2008 Zhang et al. 34/597
7,325,330 B2 * 2/2008 Kim et al. 34/407
7,347,009 B2 * 3/2008 Ahn et al. 34/607
7,356,945 B2 * 4/2008 Choi et al. 34/597
7,360,323 B2 * 4/2008 Lee et al. 34/601
7,367,137 B2 * 5/2008 Jonsson et al. 34/265
7,377,052 B2 * 5/2008 Maruca 34/201
7,398,902 B1 * 7/2008 Sutton 223/85
7,406,780 B2 * 8/2008 Doh et al. 34/606

(56) References Cited

U.S. PATENT DOCUMENTS

| | | | | |
|---|---|---|---|---|
| 7,412,783 | B2 * | 8/2008 | Guinibert et al. | 34/572 |
| 7,415,781 | B2 * | 8/2008 | Barron et al. | 34/595 |
| 7,418,789 | B2 * | 9/2008 | Choi et al. | 34/380 |
| 7,467,483 | B2 * | 12/2008 | Guinibert et al. | 34/601 |
| 7,506,458 | B2 * | 3/2009 | Lee et al. | 34/601 |
| 7,526,877 | B2 * | 5/2009 | Kim et al. | 34/209 |
| 7,552,545 | B2 * | 6/2009 | Crawford et al. | 34/600 |
| 7,559,156 | B2 * | 7/2009 | Renzo | 34/595 |
| 7,562,467 | B2 * | 7/2009 | Doh | 34/601 |
| 7,614,162 | B2 * | 11/2009 | Renzo | 34/603 |
| 7,640,678 | B2 * | 1/2010 | Lee et al. | 34/601 |
| 2001/0020338 | A1 * | 9/2001 | Arrieta et al. | 34/202 |
| 2002/0038788 | A1 * | 4/2002 | Halleman et al. | 211/119 |
| 2003/0000105 | A1 * | 1/2003 | Song et al. | 34/595 |
| 2003/0051370 | A1 * | 3/2003 | Jeong et al. | 34/318 |
| 2003/0056393 | A1 * | 3/2003 | Lee et al. | 34/595 |
| 2003/0066206 | A1 * | 4/2003 | Woo et al. | 34/425 |
| 2004/0010936 | A1 * | 1/2004 | Han | 34/595 |
| 2004/0020073 | A1 * | 2/2004 | Lee et al. | 34/602 |
| 2004/0064966 | A1 * | 4/2004 | Baltes | 34/443 |
| 2004/0088075 | A1 * | 5/2004 | Batcher | 700/225 |
| 2004/0098878 | A1 * | 5/2004 | Park et al. | 34/595 |
| 2004/0103556 | A1 * | 6/2004 | Bang | 34/595 |
| 2004/0123488 | A1 * | 7/2004 | Han | 34/595 |
| 2004/0123490 | A1 * | 7/2004 | Pancheri et al. | 34/597 |
| 2004/0139627 | A1 * | 7/2004 | Han et al. | 34/601 |
| 2004/0143994 | A1 * | 7/2004 | Baron et al. | 34/597 |
| 2004/0154194 | A1 * | 8/2004 | Prows | 38/14 |
| 2004/0163275 | A1 * | 8/2004 | Hwang | 34/601 |
| 2004/0163276 | A1 * | 8/2004 | Han et al. | 34/603 |
| 2004/0194339 | A1 * | 10/2004 | Johnson et al. | 34/595 |
| 2004/0216326 | A1 * | 11/2004 | Kitamura et al. | 34/597 |
| 2004/0221478 | A1 * | 11/2004 | Lee et al. | 34/603 |
| 2004/0221479 | A1 * | 11/2004 | Lee et al. | 34/603 |
| 2005/0050762 | A1 * | 3/2005 | Hood et al. | 34/595 |
| 2005/0076532 | A1 * | 4/2005 | Ward et al. | 34/597 |
| 2005/0076533 | A1 * | 4/2005 | Huston et al. | 34/597 |
| 2005/0076534 | A1 * | 4/2005 | Ofosu-Asante et al. | 34/597 |
| 2005/0076535 | A1 * | 4/2005 | Guinibert et al. | 34/601 |
| 2005/0091879 | A1 * | 5/2005 | DuVal et al. | 34/597 |
| 2005/0115104 | A1 * | 6/2005 | Guinibert et al. | 34/601 |
| 2005/0120584 | A1 * | 6/2005 | DuVal et al. | 34/597 |
| 2005/0132601 | A1 * | 6/2005 | Doh | 34/601 |
| 2005/0138836 | A1 * | 6/2005 | Hwang et al. | 34/603 |
| 2005/0166419 | A1 * | 8/2005 | Regelski | 34/202 |
| 2005/0166421 | A1 * | 8/2005 | Doh et al. | 34/603 |
| 2005/0172511 | A1 * | 8/2005 | Cimetta et al. | 34/607 |
| 2005/0210698 | A1 * | 9/2005 | Casey et al. | 34/134 |
| 2005/0217139 | A1 * | 10/2005 | Hong | 34/604 |
| 2005/0223585 | A1 * | 10/2005 | Jeon et al. | 34/82 |
| 2005/0223592 | A1 * | 10/2005 | Hong | 34/601 |
| 2005/0252030 | A1 * | 11/2005 | Park et al. | 34/601 |
| 2005/0252031 | A1 * | 11/2005 | Park et al. | 34/601 |
| 2005/0252032 | A1 * | 11/2005 | Park et al. | 34/604 |
| 2005/0278972 | A1 * | 12/2005 | Maruca | 34/201 |
| 2006/0010709 | A1 * | 1/2006 | Johnson et al. | 34/201 |
| 2006/0016092 | A1 * | 1/2006 | Kim et al. | 34/130 |
| 2006/0037209 | A1 * | 2/2006 | Johnson et al. | 34/90 |
| 2006/0048405 | A1 * | 3/2006 | Baek et al. | 34/443 |
| 2006/0080860 | A1 * | 4/2006 | Clark et al. | 34/597 |
| 2006/0096114 | A1 * | 5/2006 | Hong | 34/77 |
| 2006/0097017 | A1 * | 5/2006 | Hill et al. | 223/85 |
| 2006/0101666 | A1 * | 5/2006 | Cho et al. | 34/596 |
| 2006/0112585 | A1 * | 6/2006 | Choi et al. | 34/73 |
| 2006/0117593 | A1 * | 6/2006 | Ahn et al. | 34/513 |
| 2006/0117596 | A1 * | 6/2006 | Kim et al. | 34/607 |
| 2006/0123654 | A1 * | 6/2006 | Zhang et al. | 34/348 |
| 2006/0130354 | A1 * | 6/2006 | Choi et al. | 34/73 |
| 2006/0137205 | A1 * | 6/2006 | Lee et al. | 34/60 |
| 2006/0137206 | A1 * | 6/2006 | Lee et al. | 34/86 |
| 2006/0137208 | A1 * | 6/2006 | Lee et al. | 34/130 |
| 2006/0137210 | A1 * | 6/2006 | Lee et al. | 34/201 |
| 2006/0137211 | A1 * | 6/2006 | Casella et al. | 34/231 |
| 2006/0150439 | A1 * | 7/2006 | Latack et al. | 34/601 |
| 2006/0162180 | A1 * | 7/2006 | Heilman et al. | 34/389 |
| 2006/0179678 | A1 * | 8/2006 | Jonsson et al. | 34/195 |
| 2006/0230630 | A1 * | 10/2006 | Lee et al. | 34/108 |
| 2006/0236560 | A1 * | 10/2006 | Doh et al. | 34/596 |
| 2006/0242856 | A1 * | 11/2006 | Kim et al. | 34/202 |
| 2006/0254082 | A1 * | 11/2006 | Kim | 34/595 |
| 2006/0265899 | A1 * | 11/2006 | Renzo | 34/603 |
| 2006/0288605 | A1 * | 12/2006 | Carow et al. | 34/446 |
| 2006/0288608 | A1 * | 12/2006 | Carow et al. | 34/604 |
| 2007/0006477 | A1 * | 1/2007 | Guinibert et al. | 34/85 |
| 2007/0089317 | A1 * | 4/2007 | Crawford et al. | 34/237 |
| 2007/0094888 | A1 * | 5/2007 | Barron et al. | 34/597 |
| 2007/0113419 | A1 * | 5/2007 | Belgard | 34/82 |
| 2007/0144032 | A1 * | 6/2007 | Maruca | 34/469 |
| 2007/0151120 | A1 * | 7/2007 | Tomasi et al. | 34/601 |
| 2007/0169279 | A1 * | 7/2007 | Park et al. | 8/149.3 |
| 2007/0186440 | A1 * | 8/2007 | Guinibert et al. | 34/603 |
| 2007/0220776 | A1 * | 9/2007 | Guinibert et al. | 34/603 |
| 2007/0227030 | A1 * | 10/2007 | Oh et al. | 34/60 |
| 2007/0256322 | A1 * | 11/2007 | Kim et al. | 34/603 |
| 2007/0277393 | A1 * | 12/2007 | Tunguy-Desmarais | 34/603 |
| 2008/0022551 | A1 * | 1/2008 | Banta et al. | 34/602 |
| 2008/0034607 | A1 * | 2/2008 | Ahn et al. | 34/130 |
| 2008/0034608 | A1 * | 2/2008 | Ahn et al. | 34/134 |
| 2008/0034611 | A1 * | 2/2008 | Carow et al. | 34/565 |
| 2008/0141550 | A1 * | 6/2008 | Bae et al. | 34/68 |
| 2008/0141554 | A1 * | 6/2008 | Bae et al. | 34/132 |
| 2008/0141558 | A1 * | 6/2008 | Bae et al. | 34/595 |
| 2008/0189978 | A1 * | 8/2008 | Aizpuru Borda et al. | 34/549 |
| 2008/0235984 | A1 * | 10/2008 | Yoon | 34/601 |
| 2008/0256826 | A1 * | 10/2008 | Zarembinski | 34/562 |
| 2008/0289212 | A1 * | 11/2008 | Moon et al. | 34/267 |
| 2009/0056161 | A1 * | 3/2009 | Ahn et al. | 34/79 |
| 2009/0064531 | A1 * | 3/2009 | Moon et al. | 34/491 |
| 2009/0071033 | A1 * | 3/2009 | Ahn et al. | 34/595 |
| 2009/0113745 | A1 * | 5/2009 | Choi et al. | 34/139 |
| 2009/0151188 | A1 * | 6/2009 | Moon et al. | 34/218 |
| 2009/0151193 | A1 * | 6/2009 | Moon et al. | 34/621 |
| 2009/0165323 | A1 * | 7/2009 | Lee et al. | 34/108 |
| 2009/0217545 | A1 * | 9/2009 | Banicevic et al. | 34/89 |
| 2009/0235555 | A1 * | 9/2009 | Jie Bo | 34/557 |
| 2009/0241367 | A1 * | 10/2009 | Yoo et al. | 34/493 |
| 2009/0260246 | A1 * | 10/2009 | Bae et al. | 34/60 |
| 2009/0260248 | A1 * | 10/2009 | Prajescu et al. | 34/130 |
| 2009/0260249 | A1 * | 10/2009 | Renzo | 34/201 |
| 2009/0260250 | A1 * | 10/2009 | Moon et al. | 34/202 |
| 2009/0260251 | A1 * | 10/2009 | Prajescu et al. | 34/235 |
| 2009/0320313 | A1 * | 12/2009 | Bae et al. | 34/132 |
| 2010/0018072 | A1 * | 1/2010 | Kim et al. | 34/86 |
| 2010/0058608 | A1 * | 3/2010 | Moon et al. | 34/282 |
| 2010/0077633 | A1 * | 4/2010 | Bae et al. | 34/90 |
| 2010/0083521 | A1 * | 4/2010 | Han et al. | 34/130 |

FOREIGN PATENT DOCUMENTS

| | | | | |
|---|---|---|---|---|
| DE | 4204339 | A1 * | 8/1993 | A61F 13/08 |
| DE | 19810907 | | 9/1999 | |
| DE | 19917206 | | 10/2000 | |
| DE | 10-2005-053702 | | 6/2006 | |
| EP | 1441059 | | 7/2004 | |
| GB | 2 026 147 | | 1/1980 | |
| JP | 04-126198 | | 4/1992 | |
| JP | 08228851 | A * | 9/1996 | A47B 61/00 |
| JP | 2001070696 | A * | 3/2001 | D06F 58/10 |
| JP | 2001120899 | A * | 5/2001 | D06F 59/02 |
| KR | 20-0243057 | | 10/2001 | |
| WO | WO 97/10376 | | 3/1997 | |
| WO | WO 2006/009375 | | 1/2006 | |
| WO | WO 2006/025650 | | 3/2006 | |
| WO | WO 2006/028326 | | 3/2006 | |

* cited by examiner

COMPOSITE WASHING SYSTEM

This application claims the benefit of Korean Patent Application No. P2004-99134 filed on Nov. 30, 2004 which is hereby incorporated by reference as if fully set forth herein.

BACKGROUND OF THE INVENTION

1. Field of the Invention

The present invention relates to a drying apparatus, and more particularly, to a composite washing system which is capable of continuously circulating laundry-drying air through dryers while obtaining a more efficient drying effect, so that the composite washing system has a suitable built-in structure.

2. Discussion of the Related Art

Generally, laundry dryers are adapted to dry laundry such as clothes. Such a laundry dryer receives completely-washed laundry, and then performs an operation to dry the laundry while continuously supplying hot air.

FIG. 1 illustrates a general drum dryer as an example of a conventional laundry dryer.

As shown in FIG. 1, the conventional drum dryer mainly includes a body 10, a drying drum 20, a door 40, a motor 50, a drying heater 60, and a blowing fan 70.

The body 10 defines an appearance of the drum dryer. The drying drum 20 is rotatably disposed in the body 10. A laundry inlet 11 is formed through the front of the body 10. The door 40 is mounted to the front of the body 10 to open and close the laundry inlet 11.

The motor 50 is fixedly mounted on the bottom of the body 10 inside the body 10. The motor 50 generates a drive force to rotate the drying drum 20 and the blowing fan 70.

The drying heater 60 is arranged in a hot air supply path 91 in order to heat air flowing through the hot air supply path 91. The hot air supply path 91 guides a flow of hot air supplied into the drying drum 20.

The blowing fan 70 operates to outwardly discharge the hot air, namely, drying air, flowing through the interior of the drying drum 10. The blowing fan 70 communicates with a hot air discharge path 92.

In accordance with the above-mentioned configuration, when the blowing fan 70 operates, air around the laundry dryer, namely, ambient air, is introduced into the body 10, is heated while passing through the drying heater 60, and is then introduced into the drying drum 20 while being guided by the hot air supply path 91.

Accordingly, wet laundry received in the drying drum 20 is gradually dried by the hot air.

The air used to dry the laundry while passing through the drying drum 10 is outwardly discharged while being guided by the hot air discharge path 92.

When the laundry is completely dried in accordance with repeated execution of the above-mentioned procedure, the operations of the blowing fan 70 and drying heater 60 are stopped to complete the drying cycle.

In the conventional drum dryer, however, there is a problem in that laundry is inefficiently dried because the drying cycle is carried out while the laundry is in an entangled state.

Furthermore, there is a problem in that the laundry cannot be maintained in the dryer.

To this end, a demand for a new laundry dryer has recently been made which has an increased drying capacity and enables storage of dried laundry for a prolonged period of time. To satisfy this demand, a combination type dryer has been developed, as disclosed in U.S. Published Patent Application Nos. 2004/0194339 A1 and 2004/0154194 A1. Such a combination type dryer includes a separate drying cabinet, in addition to a drum dryer, namely, a tumble dryer.

In such a combination type dryer, a drying cabinet, which has a drying compartment for various clothes, is mounted on the top of a general drum dryer having a rotatable drum such that hot air is supplied to the drying cabinet.

The drying cabinet receives hot air supplied from the drum dryer to dry clothes received in the drying cabinet. The drying cabinet may also be used to store the dried clothes for a prolonged period of time.

However, the above-mentioned combination type dryer has a problem in that it cannot be of a built-in type because it has an air discharge type structure in which the air used to dry laundry is outwardly discharged from the dryer.

In other words, where the combination type dryer is built in a wall, it is necessary to provide a sufficient built-in space to provide a sufficient gap from the surface of the wall such that air is adequately discharged away from the dryer. For this reason, the appearance of the dryer is unattractive.

Furthermore, the air discharged from the combination type dryer is hot and humid, thereby causing the indoor environment to be an environment undesirable for the user, namely, a high-temperature and humid environment.

In addition, hot air is supplied to the laundry laid on shelves or hung on hangers in the drying cabinet at limited positions, so that a part of the laundry may be excessively dried, and another part of the laundry may be incompletely dried. For this reason, there are problems of a reduced drying performance of the laundry dryer, and damage to the laundry caused by excessive drying.

SUMMARY OF THE INVENTION

Accordingly, the present invention is directed to a composite washing system that substantially obviates one or more problems due to limitations and disadvantages of the related art.

An object of the present invention is to provide a composite washing system which is capable of continuously circulating air to dry laundry contained in a drying drum and laundry contained in a drying cabinet, and uniformly drying the laundry contained in the drying cabinet.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a composite washing system comprises: a drum dryer which dries laundry to be dried, and includes a drying drum adapted to receive the laundry, a hot air supply path adapted to guide a flow of hot air, a hot air supplier arranged in the hot air supply path to generate the hot air, and an air condenser adapted to condense the hot air; a cabinet dryer which is coupled to one side of the drum dryer, and is defined with a laundry receiving compartment, the cabinet dryer including a hot air inlet duct adapted to receive the hot air flowing through the hot air supply path; and a hot air supplying device which is arranged in the cabinet dryer to receive the hot air from the hot air inlet duct and to supply the received hot air to an inside of the laundry.

The hot air supply path may include a first air supply duct which guides the hot air into the drying drum, a second air supply duct which is connected to the first air supply duct and the hot air inlet duct to guide the hot air generated from the hot air supplier into at least one of the first air supply duct and the hot air inlet duct, and a third air supply duct which guides air discharged from the drying drum to the air condenser.

The composite washing system may further comprise a filter which is arranged in the third air supply duct to filter the air discharged from the drying drum, and thus, to remove foreign matter contained in the discharged air.

The hot air supplying device may include a drying heater which heats air flowing through the hot air supply path, and a blowing fan which forcibly blows air through the hot air supply path.

The air condenser may include a condenser which condenses air discharged from the drying drum, and a condensing fan which radiates heat from the air being condensed.

The hot air supplying device may include a first hanger which has a hollow structure, and includes a plurality of first hot air outlets formed through a peripheral wall of the first hanger, and a hot air guide pipe which has opposite ends respectively connected to the first hanger and the hot air inlet duct, to receive the hot air from the hot air inlet duct and to guide the received hot air into the first hanger.

The first hanger may be downwardly inclined from a central axis of the hot air guide pipe toward the opposite ends of the first hanger.

The hot air guide pipe may be integrated with the first hanger.

In another aspect of the present invention, a composite washing system comprises: a drum dryer which dries laundry to be dried, and includes a drying drum adapted to receive the laundry, a hot air supply path adapted to guide a flow of hot air, a hot air supplier arranged in the hot air supply path to generate the hot air, and an air condenser adapted to condense the hot air; a cabinet dryer which is coupled to one side of the drum dryer, and is defined with a laundry receiving compartment, the cabinet dryer including a hot air inlet duct adapted to receive the hot air flowing through the hot air supply path; and a hot air supplying device which is arranged in the cabinet dryer to supply hot air to an inside of the laundry, and includes a first hanger having a hollow structure to enable hot air through the first hanger, a hot air guide pipe having opposite ends respectively connected to the first hanger and the hot air inlet duct, to receive the hot air from the hot air inlet duct and to guide the received hot air into the first hanger, and a plurality of first hot air outlets formed through a peripheral wall of the first hanger and a peripheral wall of the hot air guide pipe to discharge the hot air guided through the first hanger and the hot air guide pipe.

The hot air supply path may include a first air supply duct which guides the hot air into the drying drum, a second air supply duct which is connected to the first air supply duct and the hot air inlet duct to guide the hot air generated from the hot air supplier into at least one of the first air supply duct and the hot air inlet duct, and a third air supply duct which guides air discharged from the drying drum to the air condenser.

The composite washing system may further comprise a valve which is arranged in a portion of the second air supply duct connected to the first air supply duct and the hot air inlet duct, and selectively guides the hot air flowing through the second air supply duct into at least one of the first air supply duct and the hot air inlet duct.

The composite washing system may further comprise a filter which is arranged in the third air supply duct to filter the air discharged from the drying drum, and thus, to remove foreign matter contained in the discharged air.

The hot air supplying device may include a drying heater which heats air flowing through the hot air supply path, and a blowing fan which forcibly blows air through the hot air supply path.

The air condenser may include a condenser which condenses air discharged from the drying drum, and a condensing fan which radiates heat from the air being condensed.

The first hanger may be downwardly inclined from a central axis of the hot air guide pipe toward the opposite ends of the first hanger.

The hot air guide pipe may be integrated with the first hanger.

The hot air supplying device may further include a second hanger which extends from the first hanger in a state of being connected to the first hanger, and is adapted to support laundry having a long length, such as trousers, in a hanged state.

The second hanger may have a hollow structure such that the second hanger communicates with the first hanger.

The second hanger may be integrated with the first hanger.

The second hanger may include a plurality of second hot air outlets formed through a peripheral wall of the second hanger.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
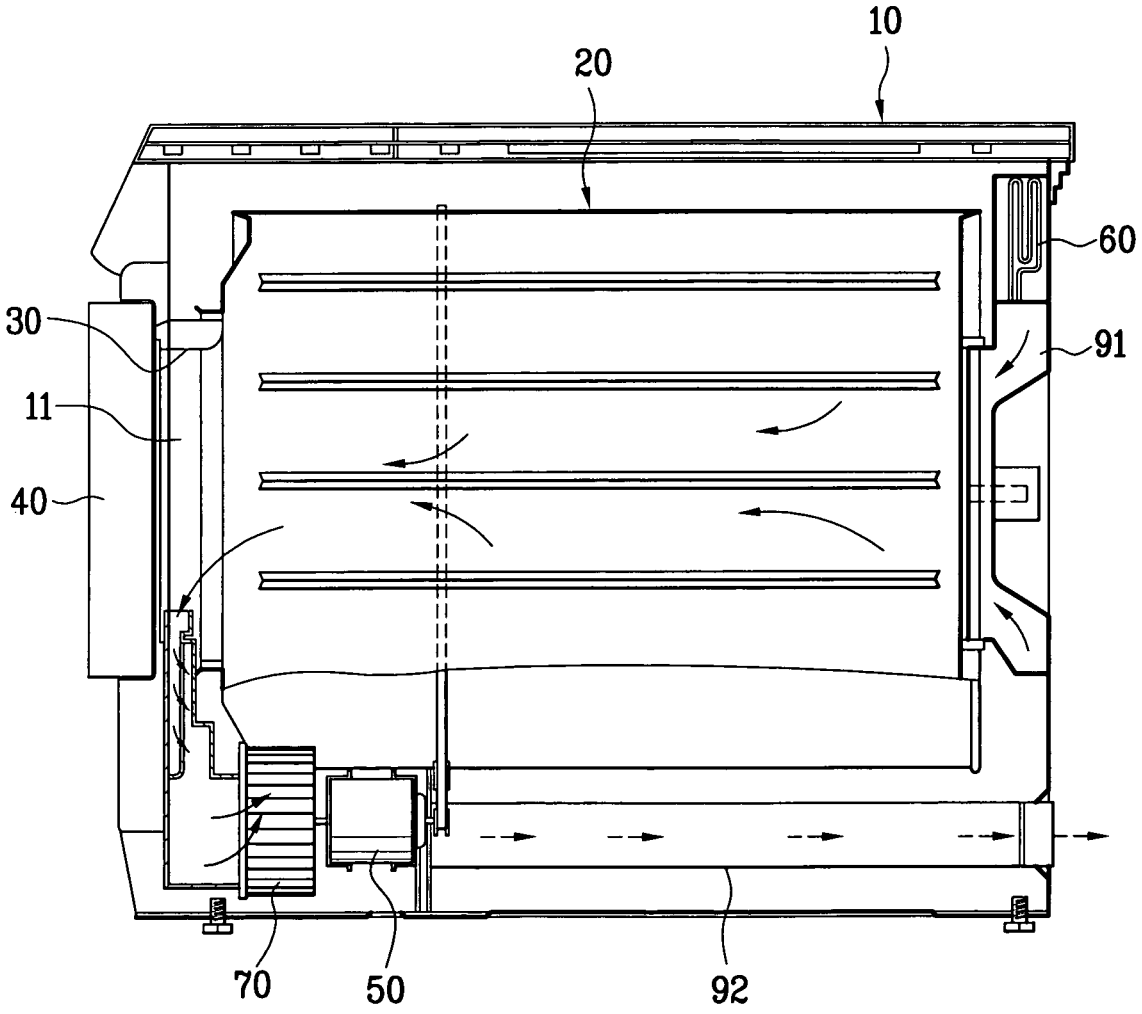
FIG. 1 Related Art
FIG. 1 is a schematic view illustrating an inner configuration of a conventional drum dryer.
Figure 2:
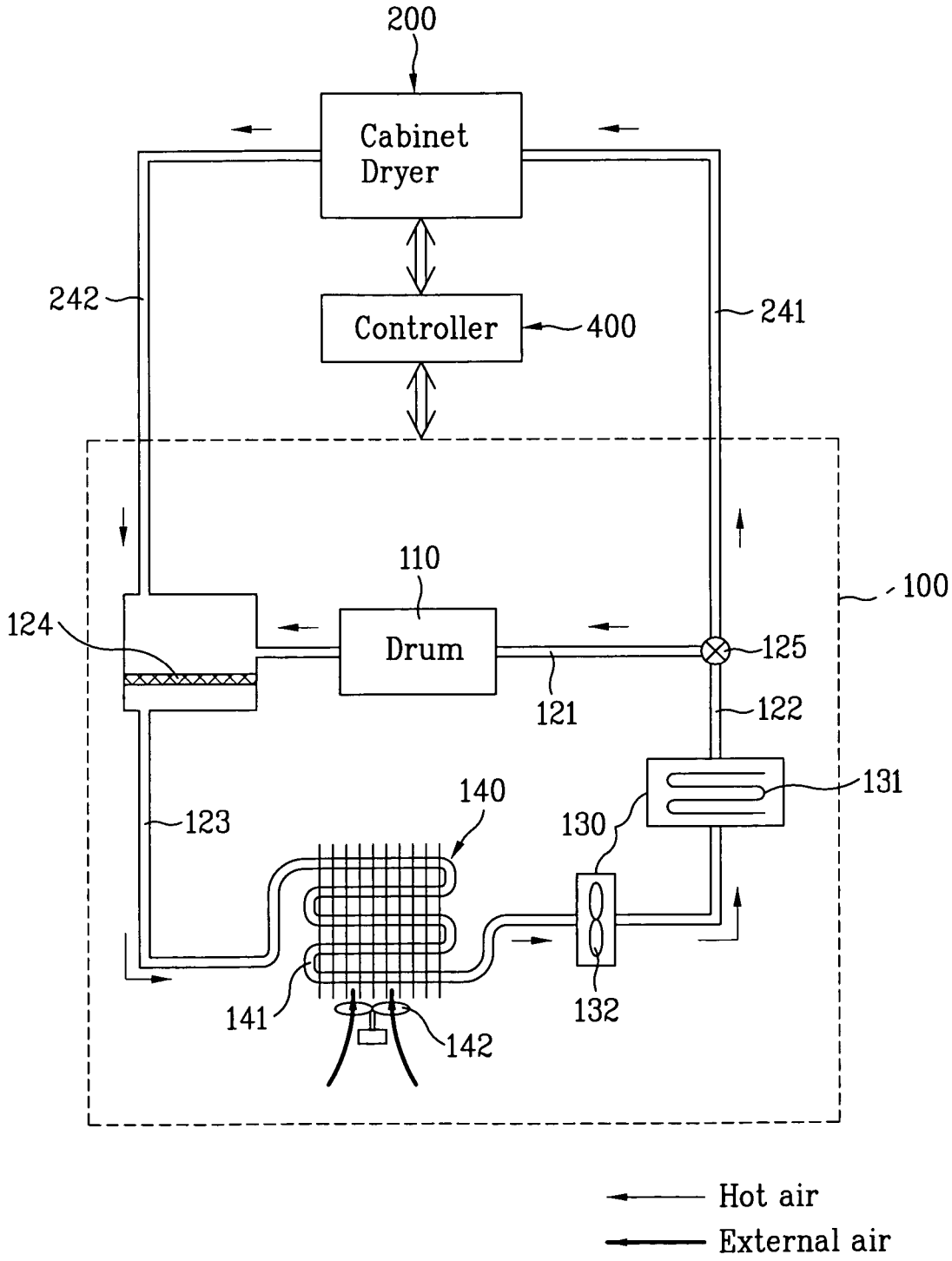
FIG. 2 is a block diagram schematically illustrating a configuration of a composite washing system according to an exemplary embodiment of the present invention.
Figure 3:
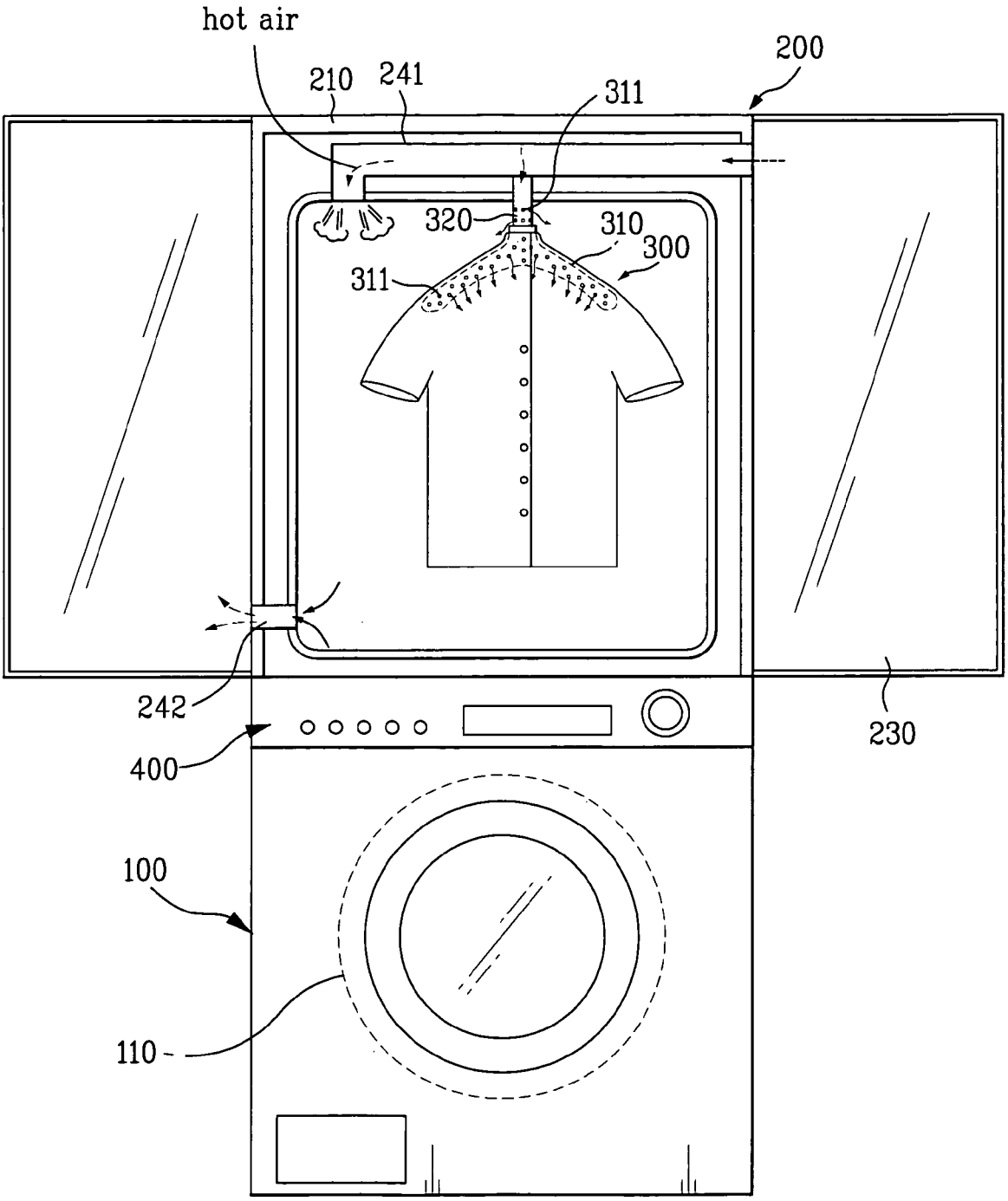
FIG. 3 is a front view schematically illustrating the configuration of the composite washing system according to the exemplary embodiment of the present invention.

FIG. 2 is a block diagram schematically illustrating a configuration of a composite washing system according to an exemplary embodiment of the present invention. FIG. 3 is a front view schematically illustrating the configuration of the composite washing system according to the exemplary embodiment of the present invention.

Figure 4:
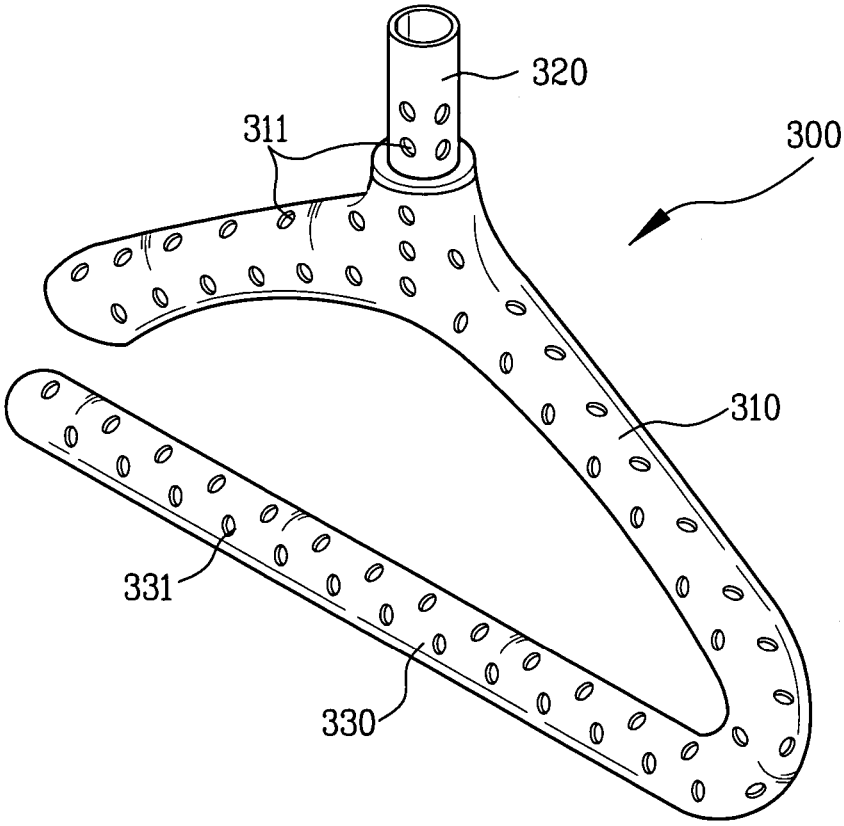
FIG. 4 is a perspective view illustrating a hot air supplying device according to an exemplary embodiment of the present invention.
Figure 5:
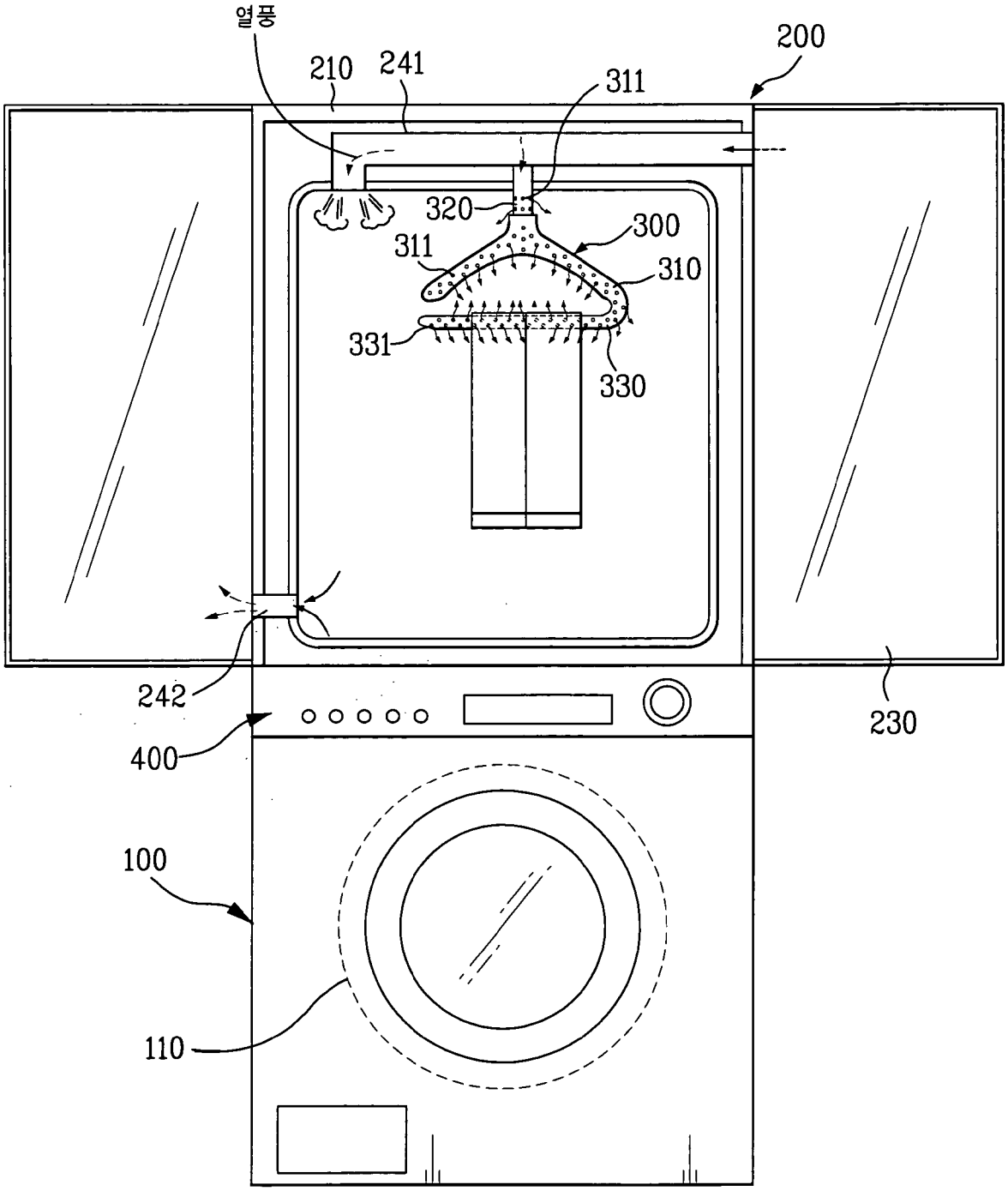
FIG. 5 is a front view schematically illustrating use of the hot air supplying device according to the exemplary embodiment of the present invention.

FIG. 4 is a perspective view illustrating a hot air supplying device according to an exemplary embodiment of the present invention. FIG. 5 is a front view schematically illustrating use of the hot air supplying device according to the exemplary embodiment of the present invention.

As shown in FIGS. 2 and 3, the composite washing system according to the exemplary embodiment of the present invention includes a drum dryer 100, a cabinet dryer 200, a hot air supplying device 300, and a controller 400.

The drum dryer 100 performs an operation to dry laundry, and may include a drying drum 110 which can perform a rotating operation and a stirring operation, a hot air supply path, a hot air supplier 130, and an air condenser 140.

The hot air supply path is a path to guide a flow of hot air. The hot air supply path communicates with an inner space defined in the system among the drying drum 110, air condenser 140, and cabinet dryer 200.

For example, the hot air supply path may include a first air supply duct 121 which supplies hot air into the drying drum 110, and a second air supply duct 122 which receives air emerging from the air condenser 140, and guides the received air into the first air supply duct 121 and/or a hot air inlet duct 241 of the cabinet dryer 200. The hot air supply path may further include a third air supply duct 123 which receives air emerging from the drying drum 110, and guides the received air into the air condenser 140.

Preferably, a filter 124 is arranged in the third air supply duct 123 to filter air passing through the third air supply duct 123, and thus, to remove foreign matter contained in the air.

The hot air supplier 130 is arranged in the second air supply duct 122 to produce hot air.

For example, the hot air supplier 130 may include a drying heater 131 which heats air passing through the second air supply duct 122, and a blowing fan 132 which forcibly blows the air heated in the second air supply duct 122.

Preferably, the blowing fan 132 is arranged in a portion of the second air supply duct 122 upstream from the drying heater 131, in order to minimize any damage to the blowing fan 132 caused by hot air.

The air condenser 140 includes a condenser 141 and a condensing fan 142, in order to condense hot and humid air flowing through the third air supply duct 123 and to radiate heat from the air.

The condenser 141 is configured to receive hot air from the third air supply duct 123 of the hot air supply path. The condenser 141 may include a pipe having a plurality of bent portions, and cooling fins arranged around the pipe.

The condensing fan 142 is adapted to blow external air toward the condenser 141.

Accordingly, humid air passing through the condenser 141 is condensed as it heat-exchanges with the external air supplied in accordance with the operation of the condensing fan 142 while passing through the pipe of the condenser 141.

The cabinet dryer 200 is defined with a laundry compartment to receive a large amount of laundry. The cabinet dryer 200 may be coupled to a portion of the drum dryer 100. In the exemplary embodiment of the present invention, the cabinet dryer 200 is illustrated as being coupled to the top of the drum dryer 100.

In this case, in addition to a hot air inlet duct 241, the cabinet dryer 200 includes a body 210, an opening/closing door 230, and an air outlet duct 242.

The body 210 defines an appearance of the cabinet dryer 200. The opening/closing door 230 is mounted to the front of the body 210 to open/close the body 210.

The hot air inlet duct 241 has one end connected to the second air supply duct 122 of the drum dryer 100, and the other end communicating with the interior of the body 210. Accordingly, the hot air inlet duct 241 receives hot air from the second air supply duct 122, and guides the received hot air into the body 210.

Preferably, a valve 125 is arranged in the second air supply duct 122 to guide the air flowing through the second air supply duct 122 toward the first air supply duct 121 and/or the hot air inlet duct 241.

The air outlet duct 242 has one end communicating with the body 210, and the other end connected to the third air supply duct 123 of the hot air supply path. Accordingly, the air outlet duct 242 functions to discharge hot and humid air passing through the laundry in the body 210.

In order to effectively achieve the air discharge, a separate discharge fan (not shown) may be arranged in the air outlet duct 242.

In accordance with the exemplary embodiment of the present invention, the hot air supplying device 300 is arranged in the cabinet dryer 200 to support laundry in a hung state in the cabinet dryer and to supply hot air through the laundry, and thus, to achieve an enhancement in drying performance.

The hot air supplying device 300 may include a first hanger 310, a hot air guide pipe 320, and first hot air outlets 311.

Preferably, the first hanger 310 has a hollow structure to enable hot air to flow through the first hanger 310. It is also preferred that the first hanger 310 be downwardly inclined from the central axis of the hot air guide pipe 320 toward opposite ends of the first hanger 310. In accordance with this structure, it is possible to conveniently hang an upper garment such as a coat or a jacket on the first hanger 310.

The hot air guide pipe 320 has one end connected to the hot air inlet duct 241, and the other end connected to the first hanger 310. Accordingly, the hot air guide pipe 320 guides a part of the hot air flowing through the hot air outlet duct 241 into the first hanger 310.

Preferably, the hot air guide pipe 320 is integrated with the first hanger 310. Of course, the hot air guide pipe 320 may be fabricated separately from the first hanger 310. In this case, the hot air guide pipe 320 may be coupled to the first hanger 310 using a separate coupling member.

The first hot air outlets 311 are formed through peripheral walls of the first hanger 310 and hot air guide pipe 320. The first hot air outlets 311 function to discharge the hot air guided into the hot air guide pipe 320 and first hanger 310 such that the discharged hot air passes through the hung laundry.

The controller 400 according to the exemplary embodiment of the present invention controls the operations of the drum dryer 100 and cabinet dryer 200.

The controller 400 may be equipped in one of the drum dryer 100 and cabinet dryer 200, or may be equipped in either the drum dryer 100 or the cabinet dryer 200. In the exemplary embodiment of the present invention, the controller 400 is illustrated as being equipped in the drum dryer 100.

Where two controllers 400 are equipped in the drum dryer 100 and cabinet dryer 200, respectively, it is preferred that the two controllers 400 be connected by a data cable (not shown), for information transfer therebetween.

Meanwhile, the controller 400 may be configured to control the drum dryer 100 and cabinet dryer 200 in an independent manner or in a linked manner.

As shown in FIG. 4, in accordance with the exemplary embodiment of the present invention, the hot air supplying device may further include a second hanger 330 which extends from a lower end of the first hanger 310 while being bent, in order to support a lower garment such as trousers in a hung state in the cabinet dryer 200.

Preferably, the second hanger 330 has a hollow structure, and has one end communicating with the first hanger 310, in order to enable a part of the hot air passing through the first hanger 310 to flow through the second hanger 330.

A plurality of second hot air outlets 331 are formed through a peripheral wall of the third hanger 330. The second hot air outlets 331 function to discharge the hot air guided into the second hanger 330 via the first hanger 310 such that the discharged hot air passes through the hung laundry to promote drying of the laundry.

Hereinafter, the drying operation and functions of the composite washing system provided with the hot air supplying device 300 in accordance with the exemplary embodiment of the present invention will be described.

First, laundry is hung on the hot air supplying device disposed in the body 210 of the cabinet dryer 200. In this state, a drying cycle is carried out.

Where the laundry is an upper garment such as a coat, the laundry is hung on the first hanger 310, as shown in FIG. 2. On the other hand, where the laundry is a lower garment such as trousers, the laundry is hung on the second hanger 330, as shown in FIG. 5.

After the hanging of the laundry on the hot air supplying device 300 is completely achieved in the above-described manner, electric power is supplied to the hot air supplier 130, thereby causing hot air to be supplied to the second air supply duct 122.

Thereafter, the valve 125 is controlled to guide the hot air flowing through the second air supply duct 122 into the hot air inlet duct 241 at the side of the cabinet dryer 200.

At this time, a part of the hot air introduced into the hot air inlet duct 241 is discharged into the body 210 of the cabinet 200.

The remaining part of the hot air introduced into the hot air inlet duct 241 is guided into the first hanger 310 via the hot air guide pipe 320 connected to the hot air inlet duct 241.

A part of the hot air flowing through the hot air guide pipe 320 and first hanger 310 reaches the laundry hung on the first hanger 310 through the first hot air outlets 311, and passes through the laundry. The remaining part of the hot air is introduced into the second hanger 330.

The hot air introduced into the second hanger 330 is discharged toward the laundry hung on the second hanger 330 through the second hot air outlets 331.

That is, the hot air introduced into the body 210 of the cabinet dryer via the hot air inlet duct 241 dries the outside of the laundry, whereas the hot air discharged toward the laundry through the hot air supplying device 300 dries the inside of the laundry. Accordingly, the laundry is uniformly dried in a reduced drying time.

The air which has become hot and humid after being used to dry the laundry is guided to the third air supply duct 123 via the air outlet duct 242 arranged at one side of the cabinet dryer.

The hot and humid air introduced into the third air supply duct 123 is then condensed while passing through the air condenser 140. The air condensed to be in a dried state is re-heated while passing through the drying heater 131. The resultant hot air is re-supplied to the body 210 of the cabinet dryer 200.

Thus, the laundry is dried as the above-described air flow is repeated for a predetermined time.

The above-described composite washing system according to the present invention has various effects as follows.

First, air flowing in the drum dryer and cabinet dryer is continuously circulated without being discharged out of the dryers in accordance with the present invention. Accordingly, the air used in the drying cycle has no influence on the indoor environment. Therefore, the present invention can provide a composite washing system having a suitable built-in structure.

Second, in accordance with the present invention, humid air discharged from the drum dryer and cabinet dryer is condensed by the air condenser, so that moisture contained in the air is removed. Accordingly, it is possible to effectively dry laundry.

Third, in accordance with the present invention, the cabinet dryer is equipped with the hot air supplying device. Accordingly, it is possible to uniformly dry laundry in a reduced drying time.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A composite washing system comprising:

a drum dryer which dries laundry to be dried, and includes a drying drum adapted to receive the laundry, a hot air supply path adapted to guide a flow of hot air, a hot air supplier arranged in the hot air supply path to generate the hot air, and an air condenser adapted to condense the hot air;

a cabinet dryer which is coupled to one side of the drum dryer, and is defined with a laundry receiving compartment, the cabinet dryer including a hot air inlet duct adapted to receive the hot air flowing through the hot air supply path; and a hot air supplying device which is arranged in the cabinet dryer to receive the hot air from the hot air inlet duct and to supply the received hot air to an inside of the laundry, wherein the hot air supply path includes:

a first air supply duct which guides the hot air into the driving drum;

a second air supply duct which is connected to the first air supply duct and the hot air inlet duct to guide the hot air generated from the hot air supplier into at least one of the first air supply duct and the hot air inlet duct; and a third air supply duct which guides air discharged from the driving drum to the air condenser, wherein a valve is arranged in the second air supply duct to guide the air flowing through the second air supply duct toward the first air supply duct and/or the hot air inlet duct.

2. The composite washing system according to claim 1, further comprising:

a filter which is arranged in the third air supply duct to filter the air discharged from the drying drum, and thus, to remove foreign matter contained in the discharged air.

3. The composite washing system according to claim 1, wherein the hot air supplying device includes:

a drying heater which heats air flowing through the hot air supply path; and a blowing fan which forcibly blows air through the hot air supply path.

4. The composite washing system according to claim 1, wherein the air condenser includes:

a condenser which condenses air discharged from the drying drum; and a condensing fan which radiates heat from the air being condensed.

5. The composite washing system according to claim 1, wherein the hot air supplying device includes:

a first hanger which has a hollow structure, and includes a plurality of first hot air outlets formed through a peripheral wall of the first hanger; and a hot air guide pipe which has opposite ends respectively connected to the first hanger and the hot air inlet duct, to receive the hot air from the hot air inlet duct and to guide the received hot air into the first hanger.

6. The composite washing system according to claim 5, wherein the first hanger is downwardly inclined from a central axis of the hot air guide pipe toward the opposite ends of the first hanger.

7. The composite washing system according to claim 5, wherein the hot air guide pipe is integrated with the first hanger.

8. A composite washing system comprising:

a drum dryer which dries laundry to be dried, and includes a drying drum adapted to receive the laundry, a hot air supply path adapted to guide a flow of hot air, a hot air supplier arranged in the hot air supply path to generate the hot air, and an air condenser adapted to condense the hot air;

a cabinet dryer which is coupled to one side of the drum dryer, and a is defined with a laundry receiving compartment, the cabinet dryer including a hot air inlet duct adapted to receive the hot air flowing through the hot air supply path; and a hot air supplying device which is arranged in the cabinet dryer to supply hot air to an inside of the laundry, and includes a first hanger having a hollow structure to enable hot air through the first hanger, a hot air guide pipe having opposite ends respectively connected to the first hanger and the hot air inlet duct, to receive the hot air from the hot air inlet duct and to guide the received hot air into the first hanger, and a plurality of first hot air outlets formed through a peripheral wall of the first hanger and a peripheral wall of the hot air guide pipe to discharge the hot air guided through the first hanger and the hot air guide pipe, wherein the hot air supply path includes:

a first air supply duct which guides the hot air into the driving drum;

a second air supply duct which is connected to the first air supply duct and the hot air inlet duct to guide the hot air generated from the hot air supplier into at least one of the first air supply duct and the hot air inlet duct; and a third air supply duct which guides air discharged from the driving drum to the air condenser, wherein a valve is arranged in the second air supply duct to guide the air flowing through the second air supply duct toward the first air supply duct and/or the hot air inlet duct.

9. The composite washing system according to claim 8, further comprising:

a valve which is arranged in a portion of the second air supply duct connected to the first air supply duct and the hot air inlet duct, and selectively guides the hot air flowing through the second air supply duct into at least one of the first air supply duct and the hot air inlet duct.

10. The composite washing system according to claim 8, further comprising:

a filter which is arranged in the third air supply duct to filter the air discharged from the drying drum, and thus, to remove foreign matter contained in the discharged air.

11. The composite washing system according to claim 8, wherein the hot air supplying device includes:

a drying heater which heats air flowing through the hot air supply path; and a blowing fan which forcibly blows air through the hot air supply path.

12. The composite washing system according to claim 8, wherein the air condenser includes:

a condenser which condenses air discharged from the drying drum; and a condensing fan which radiates heat from the air being condensed.

13. The composite washing system according to claim 8, wherein the first hanger is downwardly inclined from a central axis of the hot air guide pipe.

14. The composite washing system according to claim 8, wherein the hot air guide pipe is integrated with the first hanger.

15. The composite washing system according to claim 8, wherein the hot air supplying device further includes:

a second hanger which extends from the first hanger in a state of being connected to the first hanger, and is adapted to support laundry having a long length, such as trousers, in a hanged state.

16. The composite washing system according to claim 15, wherein the second hanger has a hollow structure such that the second hanger communicates with the first hanger.

17. The composite washing system according to claim 15, wherein the second hanger includes a plurality of second hot air outlets formed through a peripheral wall of the second hanger.

18. The composite washing system according to claim 15, wherein the second hanger is integrated with the first hanger.

* * * * *